United States Patent [19]

Dover

[11] 4,002,143

[45] Jan. 11, 1977

[54] HOT END GLASS CONTAINER COATING SYSTEM

[75] Inventor: Jerry D. Dover, Ware Shoals, S.C.

[73] Assignee: Indian Head Inc., New York, N.Y.

[22] Filed: Sept. 8, 1975

[21] Appl. No.: 611,003

[52] U.S. Cl. ..... 118/610; 118/314; 118/326; 118/DIG. 7

[51] Int. Cl.[2] ..... B05C 15/00

[58] Field of Search ..... 118/326, DIG. 7, 634, 118/603, 610, 316, 314; 98/115 SB; 251/125

[56] References Cited

UNITED STATES PATENTS

| | | | |
|---|---|---|---|
| 1,183,397 | 5/1916 | Newcomb | 118/DIG. 7 |
| 2,248,363 | 7/1941 | Kuenhold, Sr. | 251/125 X |
| 2,337,983 | 12/1943 | Fisher | 118/DIG. 7 |
| 2,661,310 | 12/1953 | Page et al. | 118/603 X |
| 2,763,575 | 9/1956 | Bede | 118/316 X |
| 3,152,923 | 10/1964 | Marshall et al. | 118/316 X |
| 3,926,103 | 12/1975 | Smith | 118/326 X |

*Primary Examiner*—John P. McIntosh
*Attorney, Agent, or Firm*—Brumbaugh, Graves, Donohue & Raymond

[57] ABSTRACT

An improved hot end glass container coating system comprises a conveyor for transporting hot glass containers, first and second pairs of spray coating units and exhaust units reversely opposed adjacent the sides of the conveyor, an air flow control unit and a coating liquid measuring and flow control unit.

1 Claim, 3 Drawing Figures

FIG. 1
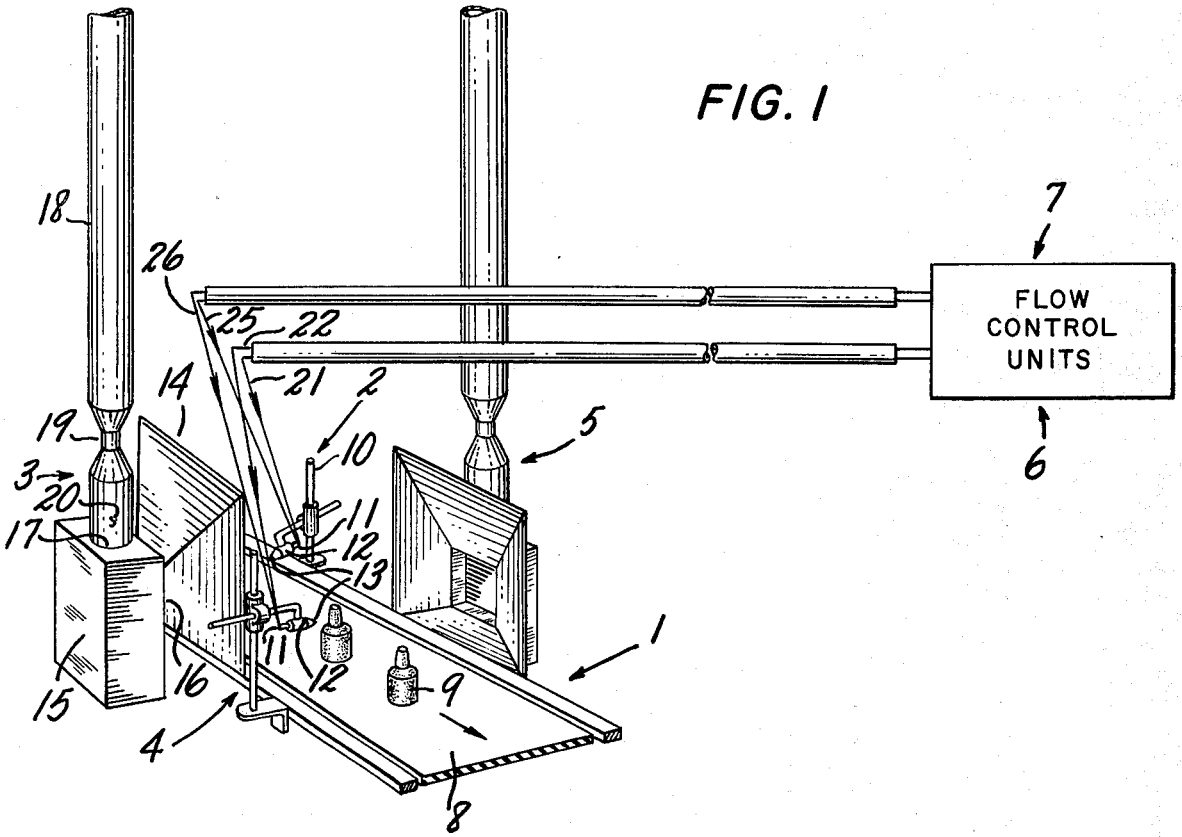
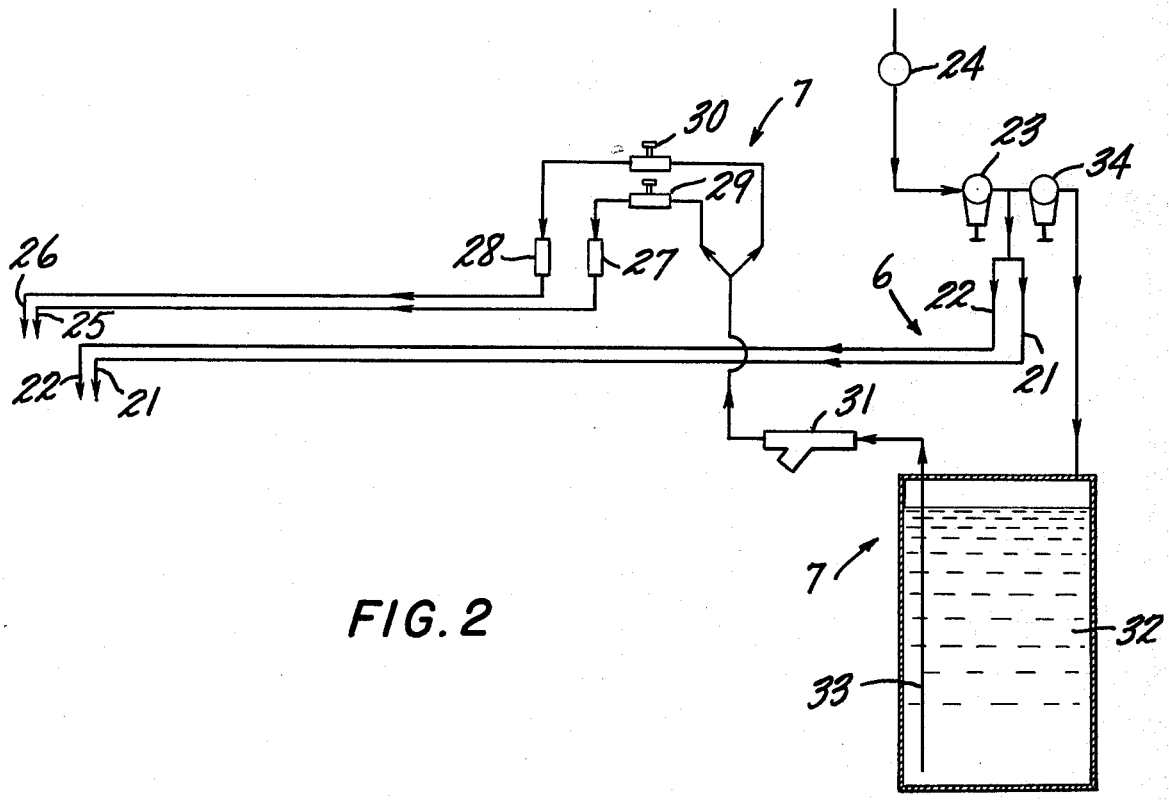
FIG. 2

HOT END GLASS CONTAINER COATING SYSTEM

BACKGROUND OF THE INVENTION

Contact between glass containers will cause external surface damage to the glass containers in the form of abrasions, bruises and scratches and thereby result in a loss of tensile strength of the glass containers. In order to protect the glass containers from such surface damage, glass containers are generally provided with a protective coating, particularly on the body portion. Such protective coating is conventionally applied at the "hot" end of the glassware manufacture line, i.e., between the glass-forming machine and the annealing lehr. At the hot end the glassware retains sufficient heat of formation so that the glassware has a temperature above about 800° F.

At the hot end the glass containers are either fume-coated or liquid spray coated with a protective coating of a composition of a metallic compound which is heat decomposable upon contact with the hot glass containers. Typical of such protective coating compositions containing a heat decomposable metallic compound are those containing a tin salt, such as stannous chloride and stannic chloride, and those containing a titanium compound, such as titanium tetrachloride and tetraisopropyl titanate, the usual metallic compound being stannic chloride. Upon contact of the heat decomposable metallic compound with the hot glass containers, the applied compound decomposes into a metallic oxide, such as, stannic oxide or titanium oxide. The metallic oxide coating protects the external surface of the glass containers against damage from abrasive contact and thereby improves the tensile strength and appearance of the glassware.

The heretofore used hot end glassware coating systems suffer from a number of disadvantages which include complexity and expense of installation, operation and control and deficiencies in performance.

SUMMARY OF THE INVENTION

It is, accordingly, the principal object of the present invention to provide an improved hot end glassware coating system which does not suffer from the drawbacks attendant to the heretofore known hot end glassware coating systems.

The improved hot end glass container coating system of the present invention comprises, in general, a conveyor for transporting hot glass containers between a glass-forming machine and an annealing lehr, first and second pairs of spray coating units and exhaust units reversely opposed adjacent the conveyor, an air flow control unit and a coating liquid measuring and flow control unit, as more fully described hereinafter.

DESCRIPTION OF THE DRAWINGS

FIG. 1 is a perspective view of the hot end glass container coating system of the invention, FIG. 2 is a diagrammatical view of the flow control units of the coating system of the invention.

DETAILED DESCRIPTION OF THE INVENTION

Figure 3:
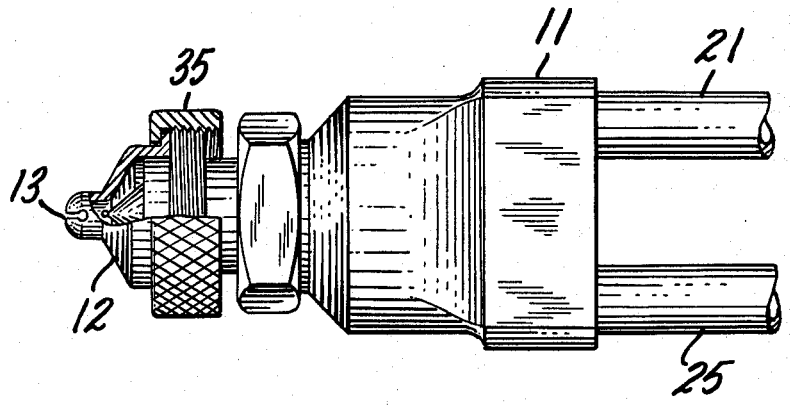
FIG. 3 is an elevational view, partly in section, of a spray nozzle having a rotatable tip with a slit opening therein.

As pointed out above, the hot end glass container coating system of the invention comprises a number of units, in combination, which include a conveyor unit 1, first and second pairs of spray coating units 2 and 4 and exhaust units 3 and 5 reversely opposed adjacent the conveyor, an air flow control unit 6 and a coating liquid measuring and flow control unit 7.

The conveyor unit 1 has an endless conveyor belt 8 for transporting a single file of upright hot glass containers 9 from a glass-forming machine (not shown) to an annealing lehr (not shown).

The first spray coating unit 2 is adjacent the right side of the conveyor belt 8 and comprises a nozzle holder 10 having adjustably mounted thereon one or more spray nozzles 11 for air atomizing the coating liquid through a rotatable tip 12 on the spray nozzle 11, the rotatable tip 12 having a slit opening 13 which is oriented across the conveyor belt 8. The slit opening 13 directs the spray outwardly in a fan-shaped configuration. This slit opening 13 can be rotatably positioned horizontally, diagonally or vertically depending on the height of the glass containers 9 being coated and the portion of the glassware to be coated by turning or rotating the unthreaded tip 12 so as to orient the slit opening 13 therein into the desired position while the threaded locking ring 35 is disengaged or loosened from the threads on the spray nozzle 11 and after the rotatable tip 12 has the slit opening 13 oriented properly, then engaging or tightening the threaded locking ring 35 on the threads of the spray nozzle 11 so as to fix or lock the rotatable tip 12 in the desired rotated position. The nozzle holder 10 has height, angle of spray and spraying distance adjustments for coating hot glass containers 9 having various diameters and heights. For tall glass containers 9 where one nozzle 11 cannot provide complete coverage, additional nozzles 11 may be added to the same nozzle holder 10.

The first venturi exhaust unit 3 is adjacent the left side of the conveyor belt 8 and is directly across the conveyor belt 8 from the first spray coating unit 2. This first venturi exhaust unit 3 comprises a tapered shield 14 facing the conveyor belt 8. The tapered shield 14 is formed of titanium to render it both corrosion and heat resistant. A separate catchbox 15, also made of titanium, has an inlet 16 on the face thereof directly connected to the tapered shield 14 and also has an outlet 17 in the top thereof. An exhaust pipe 18 is connected to the outlet 17 of the catchbox 15. A venturi 19 is mounted in the exhaust pipe 18 and an air draft inlet 20 connected to an air source (not shown) is in the exhaust pipe 18 between the venturi 19 and the catchbox outlet 17.

The second spray coating unit 4 is identical to the first spray coating unit 2 described above and is adjacent the left side of the conveyor belt 8 and is beside the first venturi exhaust unit 3.

The second venturi exhaust unit 5 is identical to the first venturi exhaust unit 3 described above and is adjacent the right side of the conveyor belt 8 and is directly across the conveyor belt 8 from the second spray coating unit 4.

The air flow control unit 6 comprises first and second air lines 21 and 22 connected to the air-atomized coating liquid spray nozzles 11 of the first and second spray coating units 2 and 4, respectively. An air pressure regulator 23 is connected to the both the first and second air lines 21 and 22 and an air pump 24 is connected to the air pressure regulator 23.

The coating liquid measuring and flow control unit 7 comprises first and second coating liquid lines 25 and 26 made of Teflon or polyethylene tubing connected to the air-atomized coating liquid spray nozzles 11 of the first and second spray coating units 2 and 4, respectively. Drippers 27 and 28 for measuring coating liquid flow rate are separately connected in each of the coating liquid lines 25 and 26. The drippers 27 and 28 function in the same manner as the hospital-type glucose dripper. The liquid flow rate is measured by counting drips per minute. The drippers 27 and 28 consist of clear tubing with a restriction inside through which coating liquid flows slowly enough to drip through the larger clear tubing, thus allowing the drips to be counted.

Coating liquid flow control valves 29 and 30 in each of the coating liquid lines 25 and 26, respectively, are separately connected to each of the flow rate measuring drippers 27 and 28. The flow control valves 29 and 30 are made of polyvinyl chloride and are needle-type which allows fine adjustment for flow control. A Y-type sediment strainer 31 is connected to both flow control valves 29 and 30 to catch any particles or debris which may clog the spray nozzles 11 and cause system failure. The sediment strainer 31 contains a 20 mesh screen which traps any particles large enough to lodge inside the spray nozzles 11.

An air pressurized supply tank 32 for a heat decomposable coating liquid, such as a 50% aqueous solution of stannic chloride, is connected to the sediment strainer 31 via dip tube 33. The supply tank 32 is a polyethylene lined metal drum having a 55 gallon capacity so as to protect the supply tank from the corrosive action of the coating liquid.

An air pressure regulator 34 is connected to the coating liquid supply tank 32 and to the air pump 24.

OPERATION OF THE SYSTEM

The hot end glass container coating system of the invention operates in the following manner:

A single file of upright hot glass containers 9 is transported on the conveyor belt 8 from the glass-forming machine (not shown) to an annealing lehr (not shown) while passing in front of the first spray coating unit 2 which applies the atomized coating liquid to the right half of the hot glass containers 9 and the second spray coating unit 4 which applies the atomized coating liquid to the left half of the hot glass containers 9. The coating liquid is forced to the spray nozzles 11 at a controlled pressure of at least 5 psi. and is atomized at the nozzle tips 12 by supplying air via air lines 21 and 22 at a controlled air pressure of at least 10 psi. The slit openings 13 in the rotatable tips 12 of the nozzles 11 direct the spray outwardly in a fan configuration onto the respective right and left halves of the hot glass containers 9.

Any overspray and particulates not deposited upon the hot glass containers are received by the tapered shields 14 and enter into the catchboxes 15. Exhaust fumes are drawn from the coating system via the exhaust pipes 18. Air from an air source (not shown) is supplied to the air draft inlets 20 and this air draft in conjunction with the reduced pressure and increased velocity in the venturis 19 serves to draw the exhaust fumes from the system and out through the exhaust pipes 18 to either a recovery unit or a pollution control unit (not shown).

Atomizing air and pressurized coating liquid are supplied to the nozzles 11 via air lines 21 and 22 and coating liquid lines 25 and 26, respectively. The air flow is controlled to a pressure of at least 10 psi. in the air lines 21 and 22 by the air pressure regulator 23 and is supplied to the air lines 21 and 22 from the air pump 24.

The coating liquid forced by a controlled air pressure of at least 5 psi. to the nozzles 11 via the coating liquid lines 25 and 26 has its flow rate measured by means of the drippers 27 and 28 and is controlled by means of the valves 29 and 30. Any particulates or debris in the coating liquid which wound tend to clog the spray nozzles 11 are removed from the coating liquid by means of the sediment strainer 31.

The coating liquid is forced from the supply tank 32 via dip tube 33 by an air pressure of at least 5 psi. controlled by the air pressure regulator 34 and delivered by the air pump 24.

What is claimed is:

1. A hot end glass container air-atomized liquid spray-coating system comprising, in combination, 1. a conveyor unit having an endless conveyor belt for transporting a single file of hot glass containers from a glass-forming machine to an annealing lehr;
2. a first spray coating unit adjacent the right side of the conveyor belt which comprises
   a. a nozzle holder,
   b. at least one air-atomized coating liquid spray nozzle adjustably mounted on the nozzle holder, and
   c. a rotatable tip on the spray nozzle having a slit opening oriented across the conveyor belt;
3. a first venturi exhaust unit adjacent the left side of the conveyor belt and directly across the conveyor belt from the first spray coating unit which comprises
   a. a tapered shield facing the conveyor belt,
   b. a separate catchbox having an inlet in the face thereof directly connected to the tapered shield and having an outlet in the top thereof,
   c. an exhaust pipe connected to the outlet of the catchbox,
   d. a venturi in the exhaust pipe, and
   e. an air draft inlet in the exhaust pipe between the venturi and the catchbox outlet and connected to an air source;
4. a second spray coating unit identical to the first spray coating unit adjacent the left side of the conveyor belt and beside the first venturi exhaust unit;
5. a second venturi exhaust unit identical to the first venturi exhaust unit adjacent the right side of the conveyor belt and directly across the conveyor belt from the second spray coating unit;
6. an air flow control unit which comprises
   a. first and second air lines connected to the air-atomized coating liquid spray nozzles of the first and second spray coating units, respectively,
   b. an air pressure regulator connected to both the first and second air lines, and
   c. an air pump connected to the air pressure regulator; and
7. a coating liquid measuring and flow control unit which comprises
   a. first and second coating liquid lines connected to the air-atomized coating liquid spray nozzles of the first and second spray coating units, respectively,
   b. flow rate measuring drippers separately connected in each of the coating liquid lines,
   c. flow control valves in each of the coating liquid lines and separately connected to each of the flow rate measuring drippers, d. a sediment strainer connected to both flow control valves, e. an air pressurized supply tank for a heat decomposable coating liquid connected to the sediment strainer via a dip tube, and f. an air pressure regulator connected to the coating liquid supply tank and to the air pump.

* * * * *